US009724696B2

(12) United States Patent
Peltomaki

(10) Patent No.: US 9,724,696 B2
(45) Date of Patent: Aug. 8, 2017

(54) WEAR PART FOR A JAW CRUSHER, JAW CRUSHER, MINERAL MATERIAL PROCESSING AND METHOD FOR FIXING A WEAR PART

(75) Inventor: Kari Peltomaki, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 438 days.

(21) Appl. No.: 14/385,678

(22) PCT Filed: Mar. 19, 2012

(86) PCT No.: PCT/FI2012/050255

§ 371 (c)(1),
(2), (4) Date: Sep. 16, 2014

(87) PCT Pub. No.: WO2013/140014

PCT Pub. Date: Sep. 26, 2013

(65) Prior Publication Data

US 2015/0048190 A1 Feb. 19, 2015

(51) Int. Cl.
*B02C 1/10* (2006.01)
*B02C 1/04* (2006.01)

(52) U.S. Cl.
CPC ..... *B02C 1/10* (2013.01); *B02C 1/04* (2013.01); *B02C 2210/02* (2013.01); *Y10T 29/49826* (2015.01)

(58) Field of Classification Search
CPC ..... B02C 1/10; B02C 1/04; B02C 2210/02; Y10T 29/49826
See application file for complete search history.

(56) References Cited

U.S. PATENT DOCUMENTS 3,804,345 A 4/1974 DeDiemar
6,155,507 A 12/2000 Ostergaard

FOREIGN PATENT DOCUMENTS

| | | |
|---|---|---|
| EP | 1049539 | 5/2007 |
| GB | 190909454 | 0/1910 |
| GB | 214371 | 4/1924 |
| JP | 2001-170507 A | 6/2001 |

OTHER PUBLICATIONS

Chinese Office Action dated Oct. 12, 2015 (Chinese Application No. 201280071634.5).
Translation of Chinese Office Action dated Oct. 12, 2015 (Chinese Application No. 201280071634.5).
(Continued)

*Primary Examiner* — Mark Rosenbaum
(74) *Attorney, Agent, or Firm* — Andrus Intellectual Property Law, LLP

(57) ABSTRACT

A wear part for a jaw crusher comprises at a first side a wear surface to be directed to a crushing chamber of the crusher; and at an opposite second side a first counter surface which is fixable against a fixed or movable jaw of the crusher in a detach-able manner. The wear part comprises second counter surfaces inclined in opposite directions, for holding the wear part in place vertically and in a centering way in side direction relative to the jaw. A jaw crusher, a mineral material processing plant and a method for fixing a wear part to a jaw of a jaw crusher in a detachable manner. A wedge tightening coming from three directions is locking the wear part in a centering way in place relative to any possible transfer direction.

18 Claims, 6 Drawing Sheets

(56) References Cited

OTHER PUBLICATIONS

International Preliminary Report on Patentability for PCT/FI2012/050255 dated Feb. 19, 2014.
International Search report and Written Opinion for PCT/FI2012/050255 dated Nov. 30, 2012.
Response to Written Opinion for PCT/FI2012/050255 dated Jan. 20, 2014.

WEAR PART FOR A JAW CRUSHER, JAW CRUSHER, MINERAL MATERIAL PROCESSING AND METHOD FOR FIXING A WEAR PART

CROSS-REFERENCE TO RELATED APPLICATIONS

This application is the U.S. national stage application of International Application PCT/NO2012/050255, filed Mar. 19, 2012, which international application was published on Sep. 26, 2013, as International Publication WO2013/140014 in the English language. The international application is incorporated herein by reference, in entirety.

FIELD OF THE INVENTION

The invention relates to jaw crusher for a jaw crusher, a jaw crusher, a mineral material processing plant and a method for fixing a wear part to a jaw crusher.

BACKGROUND OF THE INVENTION

Mineral material such as rock is gained from the earth for processing by exploding or excavating. Rock can also be natural and gravel or construction waste. The processing is typically crushing and/or screening of material. Mobile processing apparatuses and stationary applications are used in the processing. An excavator or wheeled loader loads the material to be processed into a feed hopper of the processing plant from where a feeder feeds the material to be processed into a jaw of a crusher or onto a screen deck. The material to be processed can also be recyclable material such as concrete, plastic, wood, metal, bricks or asphalt.

Movable material processing plants are track or wheel based and can comprise means for feeding material such as a feed hopper, a feeder, a screen and one or more conveyors for transferring the processed material for storing or further processing.

Generally the jaw crusher is used as a so called primary phase crusher in which for example stone exploded from solid rock is crushed to a more suitable particle size for a following phase processing.

Typically the jaw crusher comprises a so called fixed jaw which is attached to a body, and a pitman movable relative to an eccentric shaft, a so called movable jaw. The jaws are comprising one or more wear parts fixed onto a surface of the jaw and receiving wear and deformations due to the crushed rock.

In some cases operating problems are detected when peaks and grooves of teeth of the wear part are not staying in line with each other because moving of a wear part relative to the jaw during the crushing. Problems are among others increased side forces and an unstable quality of the crushed product. Separate centering pieces are mounted between side plates and the wear part in some crushers which pieces eliminate side clearances between the side plates and the wear part. Detaching of wear parts centered in this way may nevertheless be problematic in connection with replacement or rotation of the wear part because worn wear parts are deformed during lifetime in width and longitudinal direction. The wear parts may thus stay compressed in the body of the crusher and the detaching thereof may be difficult and time consuming.

A centering protrusion in a pitman according to prior art must be filling welded and machined from time to time because of wearing. The operation is burdensome and time consuming because one must climb into the crushing chamber of the crusher to narrow and inconvenient working conditions.

A jaw crusher is known from the publication EP 1049539 B1. A wear part fixed to a fixed jaw or a movable jaw can be a single-part or a multi-part wear part.

An object of the invention is to improve fixing of a wear part for a jaw crusher and a mineral material processing plant in order to avoid or at least minimize problems associated with the prior art.

SUMMARY

According to a first example aspect of the invention there is provided a wear part for a jaw crusher which wear part comprises at a first side a wear surface to be directed to a crushing chamber of the crusher; and at an opposite second side a first counter surface which is fixable against a fixed or movable jaw of the crusher in a detachable manner; and the wear part comprises second counter surfaces inclined in opposite directions, for holding the wear part in place vertically and in a centering way in side direction relative to the jaw.

Preferably two second counter surfaces inclined in opposite directions are arranged to act as a pair centering the wear part in side direction.

Preferably a part of a recess formed in the first counter surface is defining the second counter surface. Preferably a part of a recess which is formed in an edge of the first counter surface is defining the second counter surface. Preferably the second counter surface is formed to a side wall of a recess which is formed in the first counter surface.

Preferably the second counter surfaces located in the side walls of recesses which are formed in the first counter surface are, during operation under compression, intended to face a second fixing part (which is formed to for example an outstanding wedge part or fixing wedge) which is formed in the jaw, which second fixing part comprises second fixing surfaces acting as counter forms for the second counter surfaces such that the second counter surfaces inclined in opposite directions relative to the fixing surface and the fixing surfaces are acting like wedges inclined in two directions.

The second fixing part formed in the jaw may be formed of a solid piece by machining. Preferably the second fixing part is arranged in the jaw by joining a separate second fixing part to the jaw, for example to a form such as a groove or recess formed in the jaw. The joining may be made by welding. Preferably the joining is made with bolts among others for making easier the changing of the wearing part.

Preferably the second counter surfaces inclined in opposite directions are inclined in two directions relative to the first counter surface (V- or A-wedge).

Preferably the second counter surfaces are additionally inclined in a direction which is arranged to lead the first counter surface against the jaw of the crusher when the wear part is pressed vertically relative to the jaw. Preferably the wear part is pressed vertically relative to the jaw during mounting and use of the wear part. Preferably the second counter surfaces are pressed vertically against the second counter surfaces comprised by the jaw during mounting and use of the wear part.

Preferably the second counter surfaces are, additionally to the inclination in opposite directions, inclined such that the second counter surfaces are forming an angle of more than 270° with the first counter surface of the wear part. Then, the wear part can be pressed against the jaw when a vertical compression is formed in the wear part preferably by a fixing wedge. Preferably the second counter surface is forming a wedge surface inclined in two directions relative to the first counter surface.

Preferably the wear part comprises at least one pair of second counter surfaces inclined in opposite directions.

Preferably the second counter surfaces are arranged in a V-shape. Preferably the second counter surfaces are forming a first counter surface combination in which the second counter surfaces are arranged in a V-shape. Preferably at least two second counter surfaces are forming a first counter surface combination in which a pair of second counter surfaces are arranged in a V-shape.

Preferably the second counter surfaces are arranged in an A-shape. Preferably the second counter surfaces are forming a second counter surface combination in which the second counter surfaces are arranged in an A-shape. Preferably at least two second counter surfaces are forming a second counter surface combination in which a pair of second counter surfaces are arranged in an A-shape.

Preferably the second counter surfaces are arranged in an angle of 10°-80°, preferably 30°±15°, relative to a first end of the wear part (relative to the horizontal direction). Preferably the second counter surfaces are arranged in an angle of 10°-80°, preferably 30°±15°, relative to a second end of the wear part (relative to the horizontal direction). Preferably the second counter surfaces are arranged in an angle of 10°-80°, preferably 60°±15°, relative to a longitudinal side of the wear part.

Preferably the wear part is substantially rectangular when viewed from a front direction at the side of the wear surface. Preferably by the vertical direction is intended the direction in the direction of the first counter surface of the wear part, which direction is at the same time mainly the flow direction of the material to be crushed during crushing.

Preferably the second counter surfaces are arranged behind a region of the wear surface which is exposed to wear when viewed from a direction of the wear surface.

Preferably the second counter surfaces are arranged in connection with a first end and/or a second end of the first counter surface of the wear part.

Preferably the second counter surfaces are arranged, during mounting of the wear part, to center the wear part in side direction to the jaw of the crusher.

Preferably the second counter surfaces are arranged, during use of the wear part, to hold in place the wear part in side direction in the jaw of the crusher.

According to a second example aspect of the invention there is provided a jaw crusher comprising two opposite jaws which are forming therebetween a crushing chamber for mineral material, of which jaws at least a first jaw is movable towards a second jaw and away from the second jaw, and at least one jaw comprises at the side of the crushing chamber a first fixing surface for receiving a first counter surface comprised by a wear part in a detachable fixable manner; and the said at least one jaw comprises second fixing surfaces inclined in opposite directions for receiving second counter surfaces inclined in opposite directions comprised by the wear part and for holding at least one wear part in place vertically and in a centering way in side direction relative to a fixed or movable jaw.

Preferably the jaw crusher comprises a wear part according to an aspect or an embodiment of the invention.

According to a third example aspect of the invention there is provided a mineral material processing plant which comprises a jaw crusher comprising two opposite jaws which are forming therebetween a crushing chamber for mineral material, of which jaws at least a first jaw is movable towards a second jaw and away from the second jaw, and at least one jaw comprises at the side of the crushing chamber a first fixing surface for receiving a first counter surface comprised by a wear part in a detachable fixable manner; and the said at least one jaw comprises second fixing surfaces inclined in opposite directions for receiving second counter surfaces inclined in opposite directions comprised by the wear part and for holding at least one wear part in place vertically and in a centering way in side direction relative to a fixed or movable jaw.

Preferably the mineral material processing plant comprises a jaw crusher according to an embodiment of the invention.

According to a fourth example aspect of the invention there is provided a method for fixing at least one wear part to a jaw of a jaw crusher in a detachable manner, the method comprising placing against each other a first fixing surface comprised by the jaw at a side of a crushing chamber of the crusher, and a first counter surface comprised by the wear part, which first counter surface is in the wear part at an opposite side of the wear surface, and the method comprising pressing against each other second fixing surfaces inclined in opposite directions comprised by the jaw and second counter surfaces inclined in opposite directions comprised by the wear part; holding the wear part in place vertically and in a centering way in side direction relative to a fixed or movable jaw of the crusher.

According to a fifth example aspect of the invention there is provided a method for fixing a wear part to a jaw crusher or a mineral material processing plant according to an aspect or an embodiment of the invention in a detachable manner, the method comprising pressing against each other second fixing surfaces inclined in opposite directions comprised by the jaw and second counter surfaces inclined in opposite directions comprised by the wear part; holding the wear part in place vertically and in a centering way in side direction relative to a fixed or movable jaw of the crusher.

Preferably directing a fixing force to the wear part from at least three different directions.

Preferably pressing the wear part vertically (in a direction of a plane defined by the first counter surface) relative to the jaw. Preferably pressing the second counter surfaces of the wear part vertically (in a direction of a plane defined by the first counter surface) towards the second fixing surfaces of the jaw.

Preferably arranging a friction joint between the jaw and the wear part by pressing the first counter surface towards the first fixing surface by means of the second counter surfaces (in cooperation with the second fixing surfaces).

Preferably the jaw crusher comprises in the jaw a fixing wedge by means of which a vertical compression can be formed to the wear part. Preferably the fixing wedge can be tightened towards the first fixing surface of the jaw. The fixing wedge may be a multi-part wedge. If desired, several one-part or multi-part fixing wedges may be mounted to the jaw, for example one fixing wedge for each pair of second counter surfaces. The fixing wedge may be tightened with known fixing means such as bolts in front of the jaw or behind the jaw or by an actuator for example behind the jaw.

The fixing wedge may be linear and inclined in one direction such that the fixing wedge has no centering action, for example when the wear part comprises a third counter surface, fixable by a fixing wedge, in connection with a second end (upper or bottom end depending of the position of the wear part) of the wear part. The fixing wedge may comprise a third fixing surface inclined in one direction which is intended to be tightened against the counter surface inclined in one direction comprised by the wear part.

The fixing force is brought to the wear part via the second end by an inclined fixing wedge (for example FIG. 7), when the wear part comprises second counter surfaces inclined in opposite directions in connection with the first end and a third counter surface inclined in one direction in connection with the second end. Then the wear part is compressed through the fixing wedge at the second end against the first fixing surface of the jaw and the fixing force is transmitted vertically through the wear part to the second end which is pressed via the second counter surfaces inclined in opposite directions and second fixing surfaces inclined in opposite directions against the first fixing surface of the jaw and is centered in side direction.

Preferably the jaw of the jaw crusher comprises second fixing surfaces inclined in opposite directions (FIG. 7) against which the second counter surfaces inclined in opposite directions of the wear part are intended to be placed.

Preferably the fixing wedge comprises fixing surfaces inclined in opposite directions which are intended to be tightened against second counter surfaces inclined in opposite directions comprised by the wear part. Preferably the fixing wedge comprises second fixing surfaces (for example the second end of the jaw in FIG. 7) acting in one direction, for example vertically downwards. The fixing wedge may comprise vertically upwards or downwards acting second fixing surfaces (for example in case of a two-part or a multi-part wear part). A vertical compression force, a property which is centering the wear part in side direction, and a friction force between the jaw and the wear part can be achieved to the wear part by the second fixing surfaces.

When the wear part is comprising second counter surfaces inclined in opposite directions in connection with the first and second end, the fixing force is brought through the second end with a fixing wedge which comprises second fixing surfaces inclined in opposite directions (for example FIGS. 9 and 10). Then the wear part is pressed via the fixing wedge at the second end against the first fixing surface of the jaw (and centered in side direction) and the tightening force is transmitted vertically through the wear part to the first end which is pressed against the first fixing surface of the jaw and centered in side direction through the second counter surfaces inclined in opposite directions and the second fixing surfaces inclined in opposite directions.

The friction joint may be achieved between the wear part and the jaw by pressing the first and second ends of the wear part against the jaw.

When the wear part is lowered in place in contact with the fixing surface of the jaw, the inclined counter surfaces of the bottom end center the wear part automatically in place. Further the fixing force directed from the upper end is pressing the wear part against the inclined surfaces, locking the wear part at the same time in place.

The pressing force can be directed to the wear part from three directions what is effectively preventing the wear part from moving horizontally or vertically.

Preferably the centering of the wear part by the V-wedge of the A-wedge is located in the lower end of the crushing chamber of the jaw crusher at a measuring location of the setting where load and wear of the wear part is normally heaviest. The same principle can be used, if desired, at the fixed and movable jaw sides.

The V-shaped or A-shaped lower wedge surface in a body of the crusher is keeping independently clean from rock particles due to its inclination and two-part-form when the wear parts are turned or changed.

There is no longer need for any separate and machinable centering wedge projection in the wear part and for any corresponding centering wedge recess in the middle of the movable jaw.

At the side of the fixed jaw there is no need for separate centering plate pieces of different thickness to be placed at the edges of the jaw such as in some cases recently.

Today's production precision is sufficient for the wear parts. The fixing of the wear part to the crusher is self-tightening. The deformation of the wear part during life is increasing the mounting tightness of the bolts and spring plates of the mounting wedge so that the wear part cannot loosen or fall in the crushing chamber due to loosening of the bolts.

In a solution according to some advantageous embodiments of the invention the centering wedge protrusion is a detachable exchange part the changing of which is easier and quicker than before. The stand-by time elapsing in service work of the crusher and the processing plant can be shortened and the working hence more enhanced.

The wearing of the counter surfaces does not harm the fixing or centering in connection with the turning or changing of the wear part because the pressing force from the upper direction is compensating a transformation of the surfaces due to a possible wear.

A wedge tightening coming from three directions is locking the wear part in a centering way in place relative to any possible transfer direction.

Different embodiments of the present invention will be illustrated or have been illustrated only in combination with one or some aspects of the invention. A person skilled in the art understands, that any embodiment of one aspect of the invention may be applied in the same aspect of the invention and in other aspects alone or as a combination with other embodiments.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
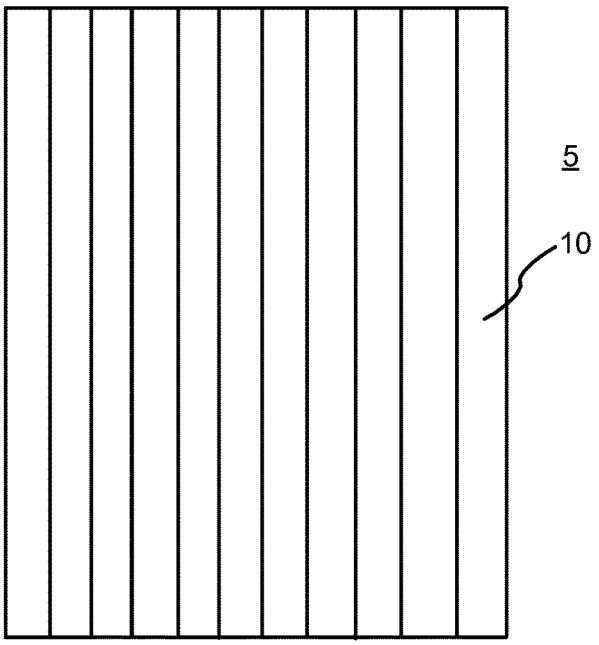
FIG. 1 shows a front view of a wear part of a jaw crusher according to an embodiment of the invention.

FIG. 1 shows a front view of wear part 5 of a jaw crusher. In the example of FIG. 1, the wear part is substantially rectangular when viewed from a front direction at a wear surface 10. The wear part 5 comprises at a first side the wear surface 10 which is during operation of the wear part directed to a crushing chamber of the crusher.

Figure 2:
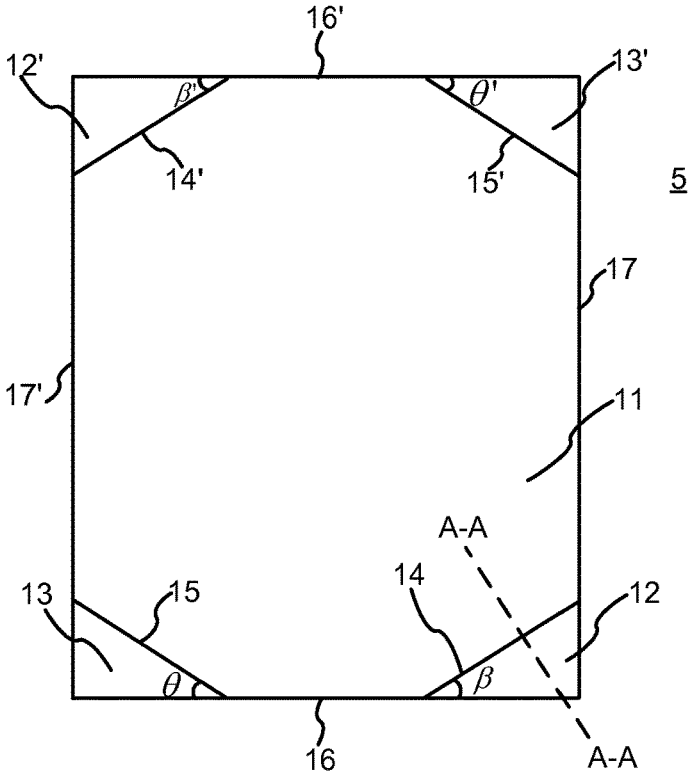
FIG. 2 shows a rear view of the wear part in FIG. 1.

FIG. 2 shows a rear view of the wear part 5. The wear part 5 comprises at a second side which is opposite to the first side a first counter surface 11 (rear surface) which is detachable fixable against the fixed or movable jaw of the crusher. A vertical first side 17 and a vertical second side 17' of the wear part are defining the width of the wear part. A horizontal first end 16 and a horizontal second end 16' of the wear part are defining the length of the wear part. Preferably planar surfaces are denoted with reference numbers 12 and 13 (12' and 13') at which planar surfaces the wear part 5 is thinner than at the broad first counter surface 11 (rear surface). The planar surfaces 12 and 13 are formed as for example a recesses to the first counter surface 11.

The planar surfaces 12 and 13 (12' and 13') are preferably located at both ends of the wear part wherein the wear part can be turned upside down when the first end 16 (bottom end) is more worn than the second end 16' (upper end) so optimizing the lifetime of the wear part.

The wear part 5 comprises second counter surfaces 14 and 15 inclined in opposite directions, respective angles β and θ, and 14' and 15', respective angles β' and θ', for holding the wear part in place vertically and for holding the wear part in a centering way in place in side direction relative to the jaw of the jaw crusher.

Two second counter surfaces 14, 15 inclined in opposite directions β and θ are arranged to act as a pair in connection with the first end 16 of the wear part which second counter surfaces are centering the wear part in side direction. Further two second counter surfaces 14', 15' inclined in opposite directions β' and θ' are arranged to act as a pair in connection with the second end 16' of the wear part which second counter surfaces are centering the wear part in side direction.

The second counter surfaces 14, 15 (14', 15') located in side walls of recesses which are formed to the first counter surface 11 are intended, during mounting and operation, to face under compression the second fixing parts 73, 74, 75 (FIG. 10) formed to the jaw of the crusher which comprise second fixing surfaces 76 acting as a counter shape such that the second counter surfaces and second fixing surfaces inclined in opposite directions relative to the first fixing surface 11 are acting as wedges inclined in two opposite directions.

Figure 3:
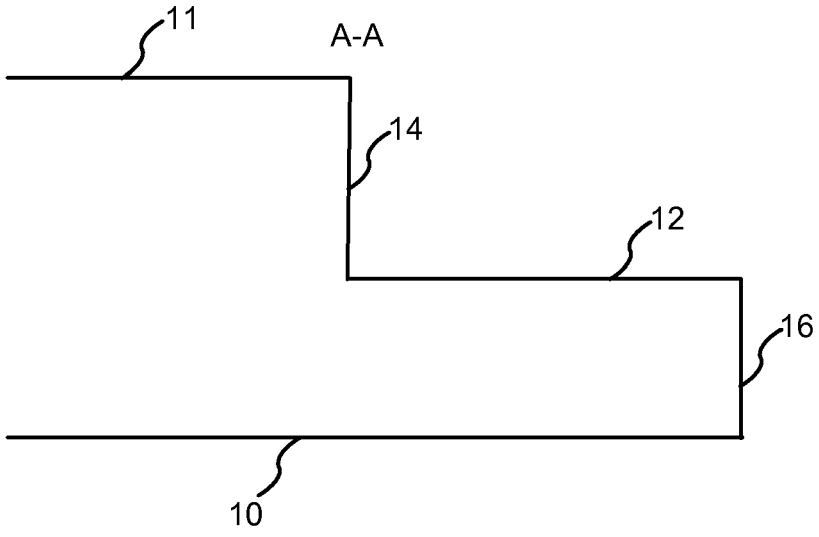
FIGS. 3 and 4 show alternative sections A-A of FIG. 2.
Figure 4:
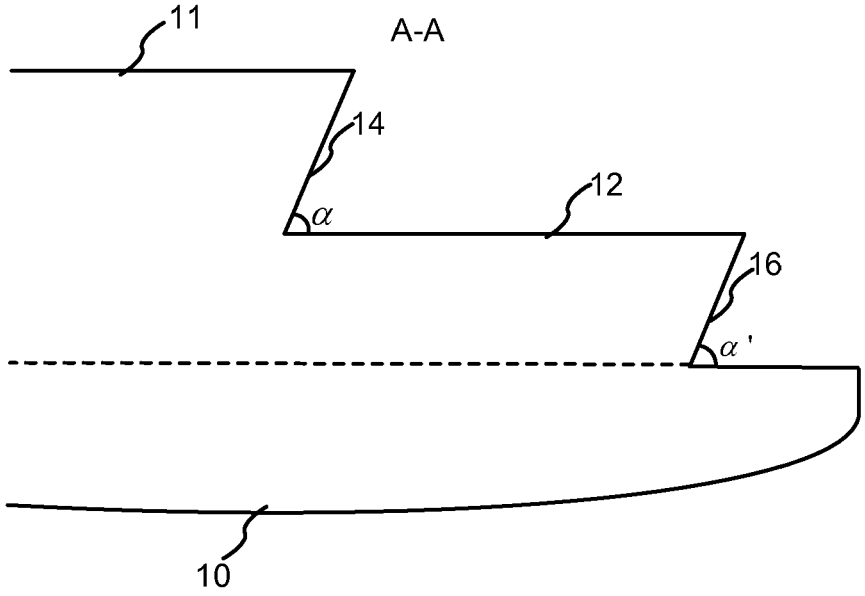

FIGS. 3 and 4 show alternative sections A-A of FIG. 2. In FIG. 3, the bottom end 16 (upper end 16') of the wear part is perpendicular to the plane 12 and the first counter surface 11.

In FIG. 4, the second counter surfaces 14 (and 15; 14' and 15') are, additionally to angles inclined in opposite directions shown in FIG. 2, inclined in such a direction which is leading the first counter surface 11 against the jaw of the crusher, when the wear part is pressed vertically. The lower end 16 (upper end 16') of the wear part is forming an angle α' relative to the plane 12 wherein the wear part can be set better in place to the jaw. A wedge-like fixing means (fixing wedge) can be arranged against the surface 16 (16') in the upper end of the jaw (pitman) which is forming to the wear part 5, in the longitudinal direction of the wear part (in this description the term vertical is also used) compressing fixing force and presses the wear part 5 against the first fixing surface of the jaw.

A section of the recess formed in an edge of the first counter surface 11 is defining the second counter surface 14 (and 15; 14' and 15'). Each second counter surface is formed to a side wall 14 (and 15; 14' and 15') of the recess which is formed in the first counter surface 11, and is forming, connected to the planar surface 12 (and 13; 12' and 13'), an inclined planar surface which can be in an angle of 90 degrees relative to the planar surface 12 (and 13; 12' and 13') (shown in FIG. 3) or in an angle α of less than 90 degrees relative to the planar surface 12 (and 13; 12' and 13') (shown in FIG. 4). The second counter surface 14 is forming an angle relative to the first counter surface 11 which is corresponding to the angle alfa. Additionally the first end 16 (bottom end) may be formed in an angle α' relative to the surface 12, which angle is corresponding to the angle α, in a region which is located behind the region where the wear part 10 is exposed to wear (behind the dashed line depicted in FIG. 4), when viewed from the direction of the wear surface.

Figure 5:
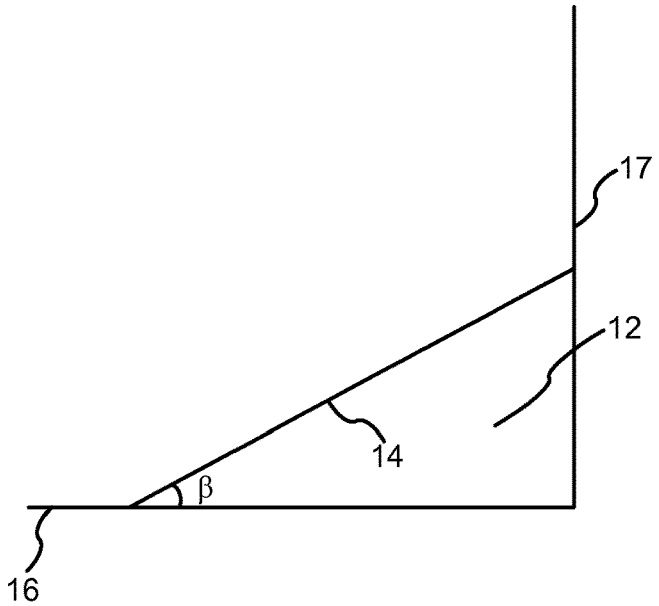
FIGS. 5 and 6 show alternative embodiments of counter surfaces inclined in opposite directions.
Figure 6:
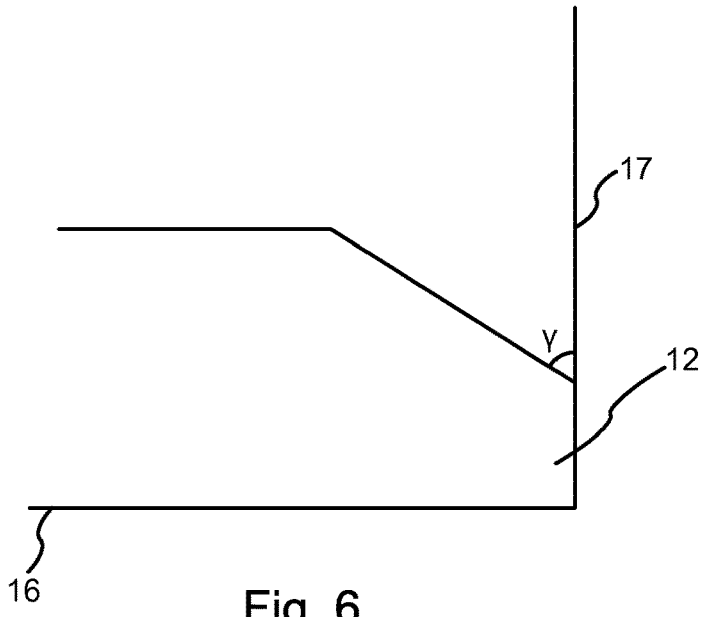

FIGS. 5 and 6 show alternative embodiments of counter surfaces inclined in opposite directions. FIGS. 5 and 6 show the right-hand edge of the downwards directed end 16 of the wear part. In FIG. 5, the second counter surfaces (counter surface 14 shown) are arranged in a V-shape according to FIG. 2. The second counter surfaces are arranged in an angle β=10°-80°, preferably β=30°±15°, relative to the end 16 of the wear part. In FIG. 5, the contact surface of the centering angle part, i.e. the second counter surface 14 is directed inclined downwards and right.

In FIG. 6, the second counter surfaces are arranged in an A-shape such that the second counter surfaces are forming an angle γ=80°-10°, preferably γ=60°±15° (complementary angle to the angle β), relative to the longitudinal side 17 of the wear part. In FIG. 6, the contact surface of the centering angle part, i.e. the second counter surface is directed inclined downwards and left.

Figure 7:
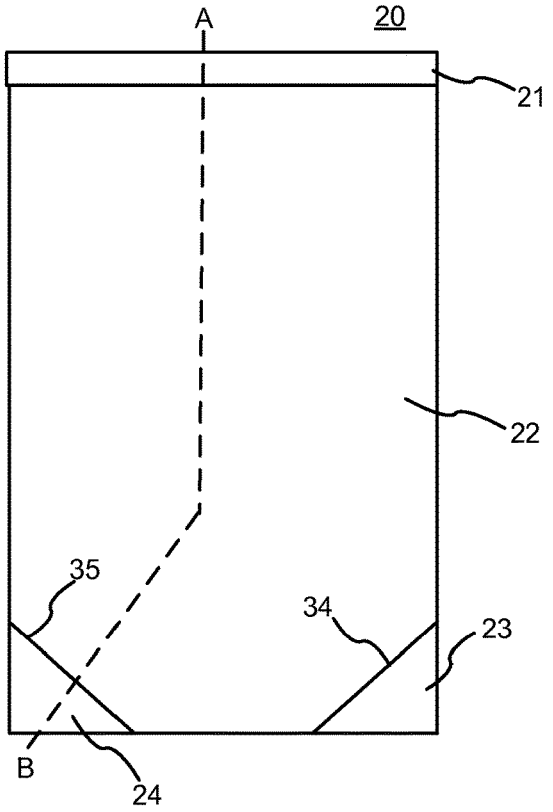
FIG. 7 shows a front view of a jaw of a jaw crusher according to an embodiment of the invention which jaw can be a movable jaw (pitman) or a fixed jaw.
Figure 8:
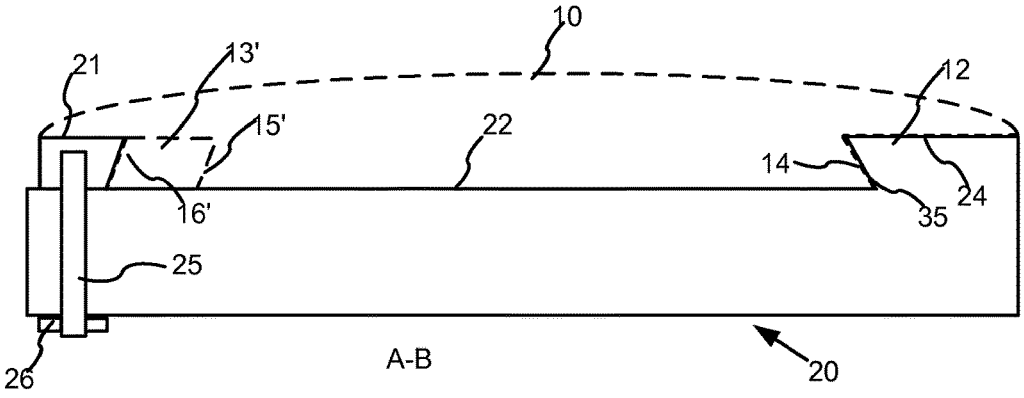
FIG. 8 shows a section A-A of the jaw in FIG. 7 to which jaw is fixed a wear part.

FIGS. 7 and 8 show a jaw 20 of a jaw crusher according to an embodiment of the invention. A front view of the jaw is shown in FIG. 7. A side view of the jaw 20 is shown in FIG. 8 such that the first end of the wear part to be located against the first fixing surface 22, and the first end of the jaw are shown right, and the second end of the wear part and the second end of the jaw are left. FIG. 8 shows a section A-B of the jaw in FIG. 7 to which jaw is fixed a wear part. The wear part is depicted with a dashed line. The wear surface 10 extends curved from the first end to the second end of the wear part.

To the jaw 20 can be fixed a wear part which comprises a similar first end (bottom end in FIG. 7) as the wear part 5 shown in FIG. 2. The second end of the wear part to be fixed to the jaw 20 comprises a third counter surface inclined in one direction, and the fixing wedge to be tightened towards the jaw comprises correspondingly a third inclined fixing surface which faces the third counter surface. The wear part to be fixed through common act of said wedge-like third fixing surfaces and counter surfaces is pressed vertically in direction of the first end of the jaw and against the first fixing surface 22.

The jaw comprises in the bottom end a two-part fixing wedge arrangement comprising second fixing parts 23 and 24 inclined in two directions, which second fixing parts are projecting from the plane defined by the first fixing surface 22 of the jaw. In FIGS. 7 and 8, the second fixing parts with the jaw are formed of a solid piece by machining. Alternatively, the fixing parts (for example fixing wedges) may be formed exchangeable, i.e., fixable in a detachable way. The second fixing parts 23 and 24 comprise upper surfaces which are preferably planar and towards which the surfaces 13 and 12 set, when the wear part is mounted to the jaw. The jaw comprises in the second fixing parts 23, 24 second fixing surfaces 34 and 35 inclined in opposite directions against which the second counter surfaces 15 and 14 inclined in opposite directions of the wear part are intended to be placed. The second fixing surfaces 34 and 35 in the second end of the jaw are formed in between the upper surfaces of the second fixing parts 23, 24 and the first fixing surface 22 of the jaw. The first angle of the second fixing surfaces 34, 35 relative to the horizontal bottom end of the jaw is corresponding to the angle βof the wear part shown in FIGS. 2 and 5, and the second angle of the second fixing surfaces 34, 35 relative to the first fixing surface 22 is corresponding to the angle α shown in FIG. 4.

In FIGS. 7 and 8, the jaw 20 comprises a movable fixing wedge 21 by which the wear part is brought to vertical compression in the jaw such that the first counter surface (rear surface) of the wear part is pressed in a friction joint against the first counter surface 22 of the jaw. The fixing wedge 21 is tightened towards the jaw by a fixing means 26. A mounting wedge may in some cases be used in between the fixing wedge 21 and the inclined counter surface of the wear part which mounting wedge may have, in a simple case, a cross-section of a parallelogram (for example for making the mounting easier).

Figure 9:
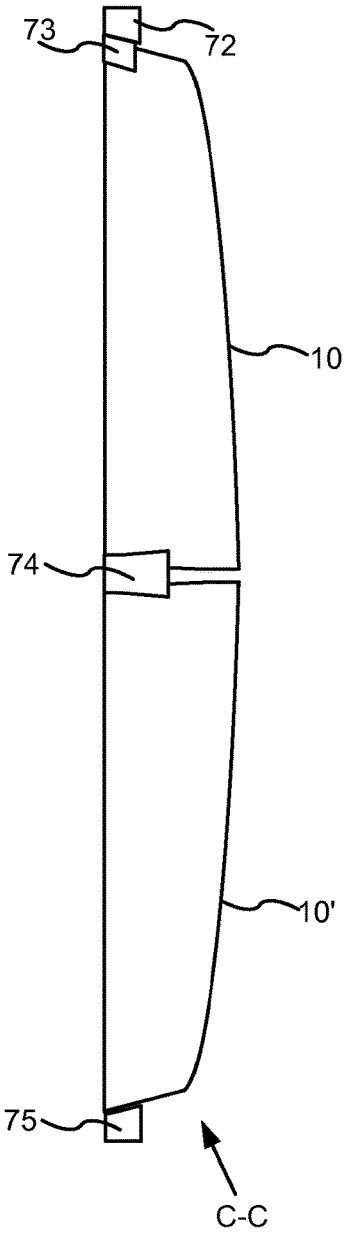
FIG. 9 shows a side view of a fixing of a two-part wear part by fixing wedges.
Figure 10:
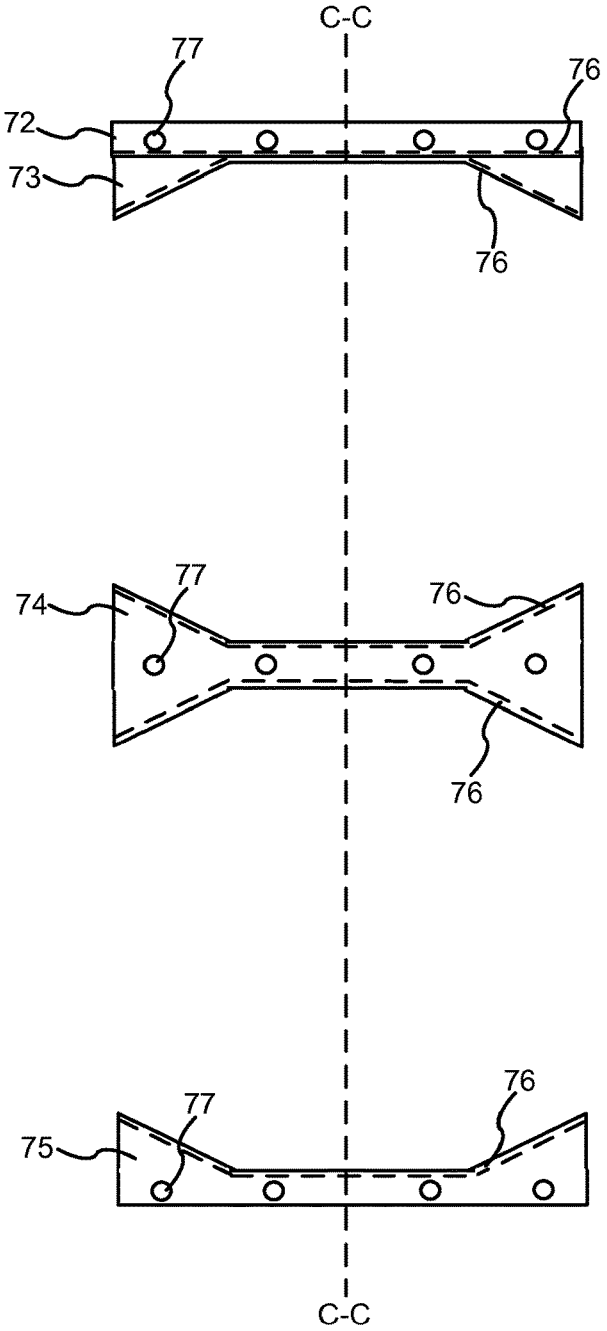
FIG. 10 shows a front view of the fixing wedges of FIG. 9.

FIG. 9 shows a side view of a fixing of a two-part (wear surfaces 10, 10') wear part by fixing wedges 72, 73, 74, 75 in the section C-C of FIG. 10. FIG. 10 shows a front view of the fixing wedges of FIG. 9 having inclined surfaces 76.

The fixing wedge 75 acting to the bottom end of the lower wear part comprises second fixing surfaces which are acting vertically upwards. The fixing wedge 74 between the wear parts comprises second fixing surfaces which are acting vertically upwards and downwards. The mounting wedge 73 acting to the upper end of the upper wear part comprises at its upper surface a third surface inclined in one direction, and at its bottom surface second fixing surfaces inclined in two directions which are acting vertically downwards. The uppermost fixing wedge 72 comprises at its bottom surface a surface which is acting against the surface inclined in one direction of the mounting wedge 73. The vertical compression force, the property which is centering the wear part in side direction and the friction force between the jaw and the wear part can be achieved by the second fixing surfaces.

In FIG. 10, the second fixing part 75 in the lower end of the jaw is formed by joining a separate fixing part to the jaw, for example to a shape such as a groove or a recess formed in the jaw. The fixing wedge 75 is preferably tightened in place at the beginning of the mounting, and the remaining fixing wedges are tightened when the wear parts are set in place. The joining of the fixing wedges 72, 74, 75 is made with bolts 77 in FIG. 10.

Figure 11:
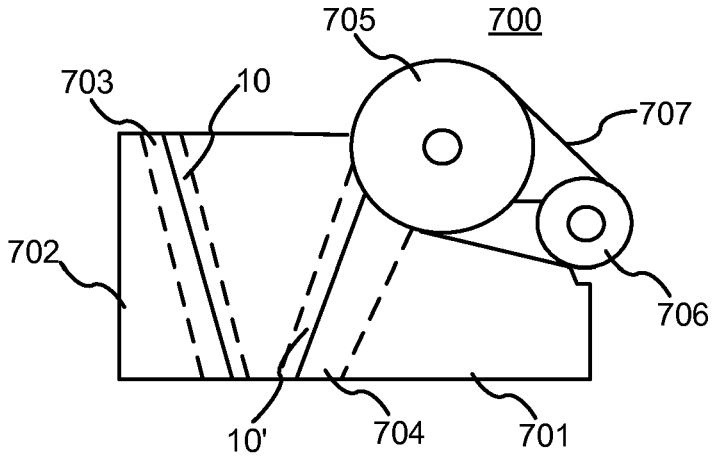
FIG. 11 shows a jaw crusher.

FIG. 11 shows a jaw crusher 700. The body of the jaw crusher is formed of a front end 702 and a rear end 701 and side plates. A fixed jaw 703 is fixed to the front end of the jaw crusher and a stationary wear part which is receiving the crushing forces is fixed to the fixed jaw. A movable wear part is fixed to a movable jaw 704, i.e. the pitman, the eccentric movement of which movable wear part is generated by rotating an eccentric shaft. The wear parts and jaws are described in more detail in connection with for example FIGS. 2 and 7.

The jaw crusher also comprises a belt wheel 705 which is connected to the eccentric, V-belts 707, a motor and a belt wheel 706 of the motor for moving the movable jaw 704. The rock material is crushed between the wear parts and is conveyed after the crushing for instance along a belt conveyor to further processing.

Figure 12:
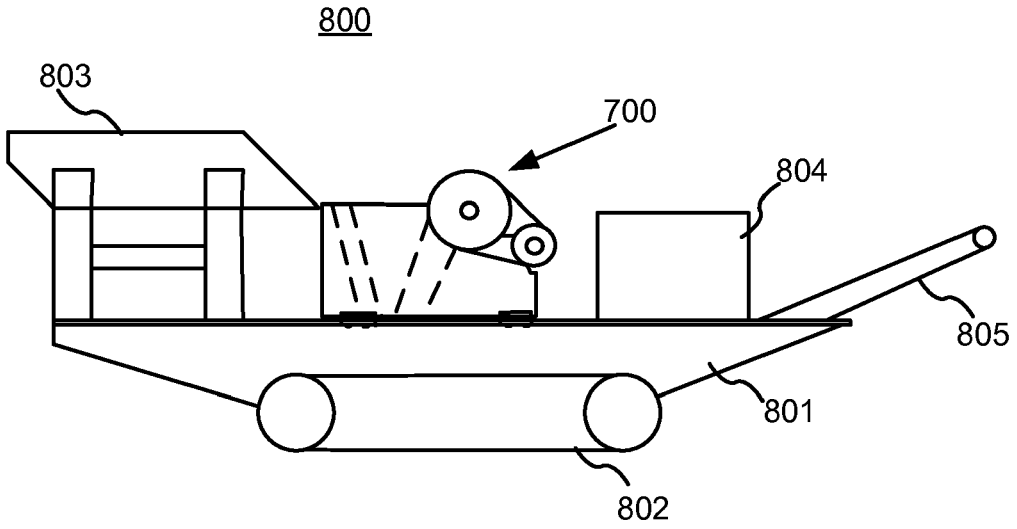
FIG. 12 shows a mineral material processing plant.

FIG. 12 shows a movable track-based mineral material processing plant 800 which comprises a feeder 803. The feeder comprises also a conveyor. The processing plant comprises a crusher 700 such as the jaw crusher of FIG. 11 and a frame 801, a power unit 804, a discharge conveyor 805 and a track base 802. The mineral material processing plant may be moved also by other means such as wheels, runners or legs or it may also be a stationary plant.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A wear part for a jaw crusher which wear part comprises at a first side a wear surface to be directed to a crushing chamber of the crusher; and at an opposite second side a first counter surface which is fixable against a fixed or movable jaw of the crusher in a detachable manner; wherein the wear part comprises, in connection with a first end of the wear part at the bottom of the wear part, a pair of second counter surfaces inclined in opposite directions with respect to each other and relative to the first end of the wear part, which second counter surfaces are arranged to hold the wear part in place vertically and to center the wear part in a side direction relative to the jaw.

2. The wear part according to claim 1, wherein the two second counter surfaces inclined in opposite directions are arranged to act as a pair centering the wear part in the side direction.

3. The wear part according to claim 1, wherein the second counter surface is formed to a side wall of a recess which is formed in the first counter surface.

4. The wear part according to claim 1, wherein the second counter surfaces inclined in opposite directions are inclined in two directions relative to the first counter surface for forming a V-wedge or an A-wedge.

5. The wear pan according to claim 1, wherein the second counter surfaces are, additionally to the inclination in opposite directions, inclined such that the second counter surfaces are forming an angle of more than 270° with the first counter surface of the wear part.

6. The wear part according to claim 1, wherein the second counter surfaces are arranged in an angle (β) of 10°-80° relative to an end of the wear part.

7. The wear part according to claim 1, wherein the second counter surfaces are arranged in an angle (γ) of 80°-10° relative to a longitudinal side of the wear part.

8. A jaw crusher comprising two opposite jaws which form therebetween a crushing chamber for mineral material, of which two opposite jaws at least a first jaw is movable towards a second jaw and away from the second jaw, and at least one jaw comprises at the side of the crushing chamber a first fixing surface for receiving a first counter surface comprised by a wear part in a detachable fixable manner; wherein the said at least one jaw comprises two second fixing surfaces inclined in opposite directions for receiving a pair of second counter surfaces comprised by the wear part in connection with a first end of the wear part at the bottom of the wear part and inclined in opposite directions with respect to each other and relative to the first end of the wear part, and arranged to hold at least one wear part in place vertically and to center the wear part inside direction relative to a fixed or movable jaw.

9. The jaw crusher according to claim 8, wherein the jaw crusher comprises a wear part comprising at a first side a wear surface to be directed to a crushing chamber of the crusher; and at an opposite second side a first counter surface which is fixable against a fixed or movable jaw of the crusher in a detachable manner; wherein the wear part comprises, in connection with a first end of the wear part at the bottom of the wear part, a pair of second counter surfaces inclined in opposite directions with respect to each other and relative to the first end of the wear part, which second counter surfaces are arranged to hold the wear part in place vertically and to center the wear part in a side direction relative to the jaw.

10. A mineral material processing plant which comprises a frame, a feeder and a jaw crusher comprising two opposite jaws which are forming therebetween a crushing chamber for mineral material, of which jaws at least a first jaw is movable towards a second jaw and away from the second jaw, and at least one jaw comprises at the side of the crushing chamber a first fixing surface for receiving a first counter surface comprised by a wear part in a detachable fixable manner; wherein the said at least one jaw comprises two second fixing surfaces inclined in opposite directions for receiving second counter surfaces comprised by the wear part in connection with a first end of the wear part at the bottom of the wear part and inclined in opposite directions with respect to each other and relative to the first end of the wear part, and arranged to hold at least one wear part in place vertically and to center the wear part in side direction relative to a fixed or movable jaw.

11. A method for fixing at least one wear part to a jaw of a jaw crusher in a detachable manner, the method comprising placing against each other a first fixing surface comprised by the jaw at a side of a crushing chamber of the crusher, and a first counter surface comprised by the wear part, which first counter surface is in the wear part at an opposite side of the wear surface, wherein the method comprises pressing against each other two second fixing surfaces inclined in opposite directions comprised by the jaw and a pair of second counter surfaces comprised by the wear part in connection with a first end of the wear part at the bottom of the wear part and inclined in opposite directions with respect to each other and relative to the first end of the wear part; holding the wear part in place vertically and in a centering way in side direction relative to a fixed or movable jaw of the crusher by the second fixing surfaces and second counter surfaces.

12. The method according to claim 11, wherein directing a fixing force to the wear part from at least three different directions.

13. The jaw crusher according to claim 9, wherein the two second counter surfaces inclined in opposite directions are arranged to act as a pair centering the wear part in the side direction.

14. The jaw crusher according to claim 9, wherein the second counter surface is formed to a side wall of a recess which is formed in the first counter surface.

15. The jaw crusher according to claim 9, wherein the second counter surfaces inclined in opposite directions are inclined in two directions relative to the first counter surface for forming a V-wedge or an A-wedge.

16. The jaw crusher according to claim 9, wherein the second counter surfaces are, additionally to the inclination in opposite directions, inclined such that the second counter surfaces are forming an angle of more than 270° with the first counter surface of the wear part.

17. The jaw crusher according to claim 9, wherein the second counter surfaces are arranged in an angle ($\beta$) of 10°-80° relative to an end of the wear part.

18. The jaw crusher according to claim 9, wherein the second counter surfaces are arranged in an angle ($\gamma$) of 80°-10° relative to a longitudinal side of the wear part.

* * * * *